United States Patent [19]

Jaakonmäki et al.

[11] Patent Number: 4,605,176

[45] Date of Patent: Aug. 12, 1986

[54] BLADE RING FOR SHAVER

[75] Inventors: Matti Jaakonmäki; Pentti Raura, both of Valko, Finland

[73] Assignee: Rauma-Repola Oy Loviisan Tehtaat, Finland

[21] Appl. No.: 748,713

[22] Filed: Jun. 26, 1985

Related U.S. Application Data

[63] Continuation of Ser. No. 456,740, Jan. 10, 1983, abandoned.

[30] Foreign Application Priority Data

Jan. 12, 1982 [FI] Finland ..... 820099

[51] Int. Cl.[4] ..... B02C 13/14

[52] U.S. Cl. ..... 241/240; 241/241; 241/300.1

[58] Field of Search ..... 241/239, 240, 241, 292.1, 241/300.1

[56] References Cited

U.S. PATENT DOCUMENTS

| | | | |
|---|---|---|---|
| 678,837 | 7/1901 | Griffin | 241/240 |
| 999,932 | 8/1911 | Wetterhold | 241/240 X |
| 2,216,612 | 10/1940 | Dimm et al. | 241/240 X |
| 3,885,745 | 5/1975 | Hankes et al. | 241/240 X |

*Primary Examiner*—Howard N. Goldberg
*Assistant Examiner*—Timothy V. Eley

[57] ABSTRACT

A blade ring for a shaver, consisting of blade units disposed in succession in ring configuration, within which a rotor rotates, urging the chips against the cutting blades. The blade units usually constitute a conical envelope, with a similar conical rotor within. The distance between the rotor and the blades is in means of prior art adjusted by shifting the rotor in axial direction, but this is difficult and requires complicated equipment. The blade ring of the invention is characterized in that each blade unit may be turned about an axis close to the cutting blade and parallelling the blade edge, for adjustment of the thickness of the shavings. By the aid of the invention, the thickness of the shavings can be regulated by simple adjustments.

2 Claims, 2 Drawing Figures

BLADE RING FOR SHAVER

This application is a continuation of application Ser. No. 456,740, filed Jan. 10, 1983, now abandoned.

The present invention concerns a blade ring for a shaver, consisting of blade units placed successively in ring form, said blade units constituting an envelope, within which a rotor rotates, pressing the chips against the cutting blades.

The blade ring is usually composed of blade units placed in conical configuration, wherewithin an equivalent conical rotor rotates. The clearance between the rotor and the blades is regulated by displacing the rotor in its axial direction. The moving of the rotor in its axial direction is difficult and requires complicated additional apparatus.

The object of the present invention is to eliminate the drawbacks presented in the foregoing and to produce a blade ring of a novel type. The blade ring of the invention is characterized in that each blade unit may be swivelled about an axis close to the cutting blade and parallelling the blade edge for adjustment of the thickness of the shavings. By the aid of the invention, it is possible simply to turn the blade units, whereby the counterblade therebehind is displaced radially with reference to the blade edge of the next blade unit. It is hereby possible to regulate the thickness of the shavings without interfering with the rotor and with its operation. After adjustment, the blade units may be clamped down immovably by the aid of flange rings on their ends. Consequently, all blade units are held firmly in their places.

Figure 1:
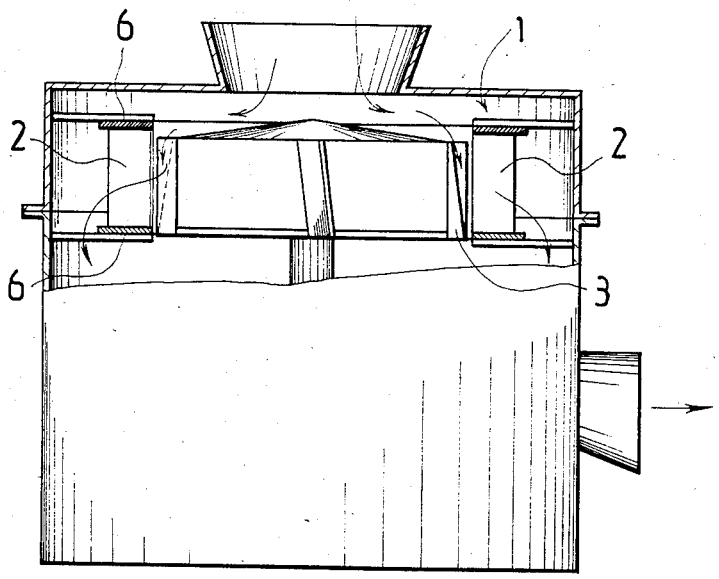

The invention is described in the following by the aid of an example with reference being made to the drawing attached, wherein FIG. 1 presents the shaver, sectioned in part.

Figure 2:
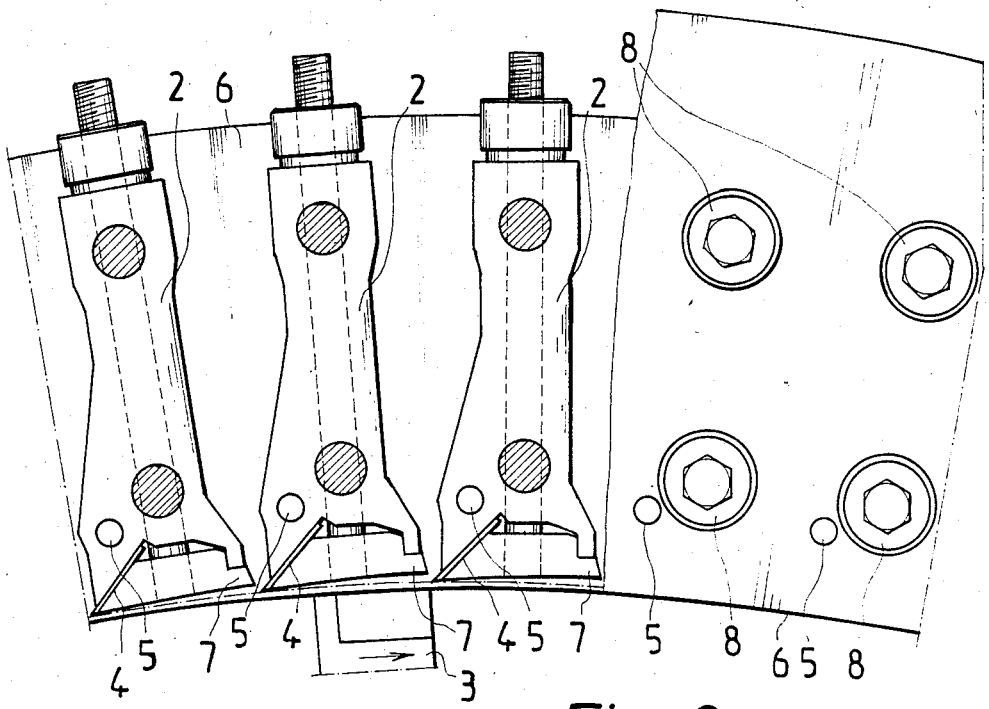

FIG. 2 presents part of the blade ring, in top view and sectioned in part.

The blade ring 1 of the shaver is composed of blade units 2 placed in ring form in succession, said blade units constituting an envelope within which a rotor 3 rotates, pressing the chips against the cutting blades 4. Each blade unit 2 may be turned about an axis close to the cutting blade and parallelling the blade edge, for adjustment of the thickness of the shavings. After being adjusted, the blade units 2 may be clamped in their places by the aid of flange rings 6 located on their ends.

The envelope formed by the blade units 2 may thus, as may also the circle formed by the rotor 3, be cylindrical as shown in FIG. 1. Adjustment of the thickness of the shavings is effected by turning the blade units 2 about the axis 5, whereby the position of the counterblade 7 trailing the blade unit changes radially with reference to the blade edge of the next blade unit. After adjustment, the blade units 2 are clamped with the aid of bolts 8 to the flange rings 6.

It is obvious to a person skilled in the art that various embodiments of the example may vary within the scope of the claims stated below.

We claim:

1. A blade ring for a shaver of chips comprising a plurality of blade units arranged in close succession in fixed ring configuration and constituting an envelope, a rotor rotatable within said envelope for only urging the chips against said blade units, each blade unit comprising a cutting blade having a cutting edge and a trailing counterblade, and means for adjustment of the thickness of the shavings of the chips comprising a pivot for each blade unit close to its respective cutting blade and paralleling its cutting edge for selectively turning said blade unit about said pivot, whereby the position of the counterblade of said blade unit is radially adjusted with reference to a cutting edge of a next blade unit to change the thickness of chip shavings.

2. Blade ring according to claim 1, wherein the blade units may after adjustment be clamped in their places by the aid of flange rings located on the ends of the blade units.

* * * * *